US006471427B1

(12) United States Patent
Boyatt, III et al.

(10) Patent No.: US 6,471,427 B1
(45) Date of Patent: Oct. 29, 2002

(54) PRINTHEAD CARRIER WITH ROTATABLE BEARINGS

(75) Inventors: Richard Gordon Boyatt, III, Lexington, KY (US); Peter Brown Pickett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 21 days.

(21) Appl. No.: 09/827,561

(22) Filed: Apr. 6, 2001

(51) Int. Cl.[7] ..... B41J 19/20
(52) U.S. Cl. ..... 400/354.1; 400/354; 347/37
(58) Field of Search ..... 400/352, 354, 400/354.1; 347/37, 38, 39

(56) References Cited

U.S. PATENT DOCUMENTS

| | | | | | |
|---|---|---|---|---|---|
| 3,960,072 | A | * | 6/1976 | Ahlgren et al. | 101/35 |
| 4,046,245 | A | | 9/1977 | Frechette | |
| 4,177,471 | A | | 12/1979 | Mitchell | |
| 4,200,402 | A | * | 4/1980 | Rix | 400/320 |
| 4,305,674 | A | | 12/1981 | Velazquez | |
| 4,349,284 | A | | 9/1982 | Andersson | |
| 4,405,246 | A | | 9/1983 | Suzaki | |
| 4,421,430 | A | | 12/1983 | Matsumoto et al. | |
| 4,440,038 | A | | 4/1984 | Potter | |
| 4,445,798 | A | | 5/1984 | Munehiro | |
| 4,493,571 | A | | 1/1985 | Potter | |
| 4,550,320 | A | | 10/1985 | Biser et al. | |
| 4,668,112 | A | | 5/1987 | Gabor et al. | |
| 4,678,355 | A | | 7/1987 | Gabor et al. | |
| 4,681,469 | A | | 7/1987 | Gabor | |
| 5,013,168 | A | | 5/1991 | Yokota et al. | |
| 5,332,321 | A | | 7/1994 | Beauchamp et al. | |
| 5,366,305 | A | | 11/1994 | Christianson | |
| 5,529,412 | A | | 6/1996 | Jadrich et al. | |
| 5,953,036 | A | * | 9/1999 | Furlani et al. | 347/139 |

FOREIGN PATENT DOCUMENTS

| | | | | |
|---|---|---|---|---|
| JP | 04090130 A | * | 3/1992 | G11B/07/085 |
| JP | 11321012 A | * | 11/1999 | B41J/25/34 |

* cited by examiner

*Primary Examiner*—Daniel J. Colilla
(74) *Attorney, Agent, or Firm*—Taylor & Aust PC

(57) ABSTRACT

A printhead carrier assembly in an ink jet printer includes a carrier moving along a linear path. At least one rotatable bearing is attached to the carrier. The at least one rotatable bearing has at least one axis of rotation. A rotatable shaft has a surface in contact with the at least one bearing such that the shaft is nonparallel to the at least one axis of rotation of the at least one rotatable bearing. The shaft is substantially parallel to the linear path of the carrier. Rotation of the shaft causes the at least one rotatable bearing to roll along a helical path on the surface of the shaft to thereby carry the carrier along the linear path.

24 Claims, 4 Drawing Sheets

PRINTHEAD CARRIER WITH ROTATABLE BEARINGS

BACKGROUND OF THE INVENTION

1. Field of the Invention.

The present invention relates to a printhead carrier in an ink jet printer, and, more particularly, to a linear motion transmission device for a printhead carrier in an inkjet printer.

2. Description of the Related Art.

With inkjet printer products, a printing mechanism containing one or more printheads 10 (FIG. 1) must be traversed across the printing surface 12. The printing mechanism is supported and slides along two smooth, round support shafts 14, only one of which is shown. The force F needed to propel the printing mechanism is applied with a toothed belt 16 attached to the printing mechanism. Toothed belt 16 is then wrapped on a pulley 18 connected to a motor that applies torque. Disadvantages of this printing mechanism system include sensitivity to the belt attachment point, uneven drive force from the motor and belt system, and high friction printing mechanism supports.

Due to the small length of an inkjet printhead, the printhead 10 must be moved in some fashion over the entire width of a piece of media 12. This is usually accomplished by traversing printhead 10 across the width of the media 12, moving the media 12 lengthwise and repeating the process until the entire piece of media 12 has been covered by printhead 10. Other methods exist, but the same principle applies.

In order for the printhead 10 or, in a color printer, group of printheads 10 to traverse, a force F must be applied to printheads 10. These printheads 10 may be contained in a carrier 20. In most inkjet printers today, belt 16 is attached to carrier 20 and applies a force F causing it to traverse. Other techniques include the use of a leadscrew, toothed rack and pinion, or linear stepper motor.

The attachment point of belt 16 should be located at the center of gravity of the carrier mechanism to prevent any undesired rotational moment forces in carrier 20. Moment forces in carrier 20 will cause the carrier mechanism to rotate, changing the relationship between the printheads 10 and media 12. This change will cause print quality defects and increase friction in the carrier supports 14 to counteract the moment forces.

Printheads 10 are directly attached to an ink tank on carrier 20. As printing operations are conducted, the amount of ink present on carrier 20 is reduced. The change of ink mass causes the center of gravity to change. Since the center of gravity changes and the belt attach remains fixed, a moment force will begin to appear as the volume of ink in the tank is reduced during printing.

One known method to counteract this moment force is to create tighter supports 14 for carrier 20. Constraining carrier supports 14 could protect carrier 20 from undesired moment forces by only allowing motion along the axis of carrier supports 14. Unfortunately, tighter supports 14 result in a higher level of friction. More force will be required to move carrier 20, and accurate motion will not be achieved due to the increased static and kinetic coefficients of friction.

To apply accurate force quickly to obtain fast carrier accelerations, a toothed belt 16 is typically used. The tooth belt 16 introduces error into the system due to the belt teeth engaging and disengaging on drive pulleys 18. This added cyclical error often results in print quality defects.

To improve on the stated limitations and problems with the belt drive system, a leadscrew assembly could be used to provide a traverse force on the carrier. The leadscrew assembly consists of a machined screw and a nut that encompasses a portion of the screw. As the screw rotates, the rotationally constrained nut moves along the screw. As the screw is rotated, the nut slides along the screw threads, but suffers from drag due to friction. Accuracy is limited to the screw profile. Another problem is that accurate leadscrews are typically cost prohibitive.

What is needed in the art is an inexpensive and accurate linear motion transmission device for a printhead carrier of an ink jet printer.

SUMMARY OF THE INVENTION

The present invention provides a continuous linear motion transmission device that can smoothly, accurately, and inexpensively traverse a printhead carrier using roller bearings that engage and are angled relative to the carrier support shaft.

The invention comprises, in one form thereof, a printhead carrier assembly in an ink jet printer. The assembly includes a carrier moving along a linear path. At least one rotatable bearing is attached to the carrier. The at least one rotatable bearing has at least one axis of rotation. A rotatable shaft has a surface in contact with the at least one bearing such that the shaft is nonparallel to the at least one axis of rotation of the at least one rotatable bearing. The shaft is substantially parallel to the linear path of the carrier. Rotation of the shaft causes the at least one rotatable bearing to roll along a helical path on the surface of the shaft to thereby carry the carrier along the linear path.

A continuous linear motion transmission device (CLMTD) is applied to transport the printing mechanism across the printing surface. This device provides smooth and even actuation force to the printing mechanism and acts as a pure rolling support for the printing mechanism. The CLMTD attaches to one of the smooth support shafts and converts rotary motion of the smooth support shaft to linear motion of the printing mechanism.

An advantage of the present invention is that it provides very smooth and accurate linear motion due to the rolling support, low friction, and the ability to limit the force applied to the printing mechanism.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
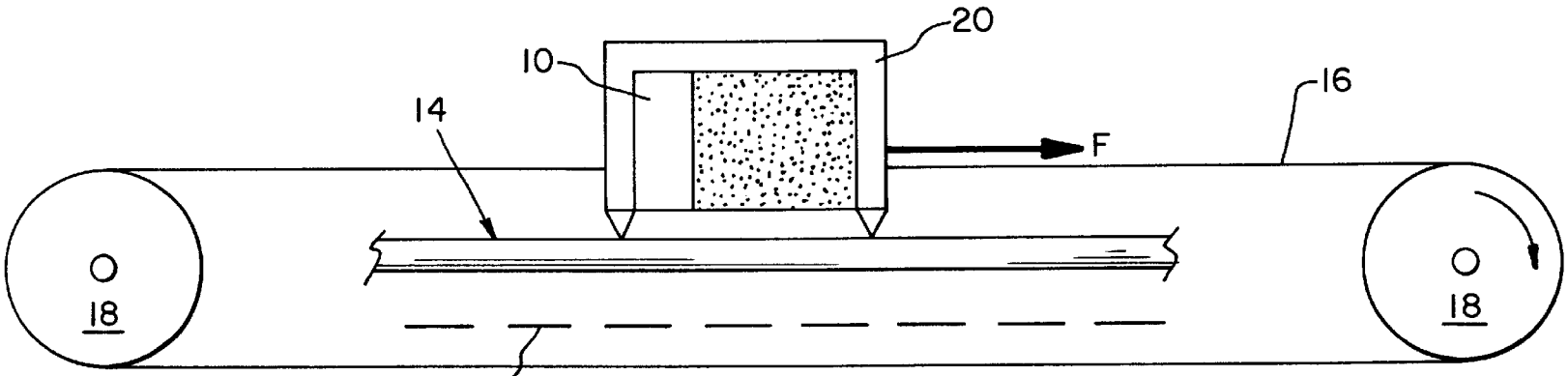
PRIOR ART Fig. 1
FIG. 1 is a fragmentary, front schematic view of a known printhead carrier transmission system in an ink jet printer.
Figure 3:
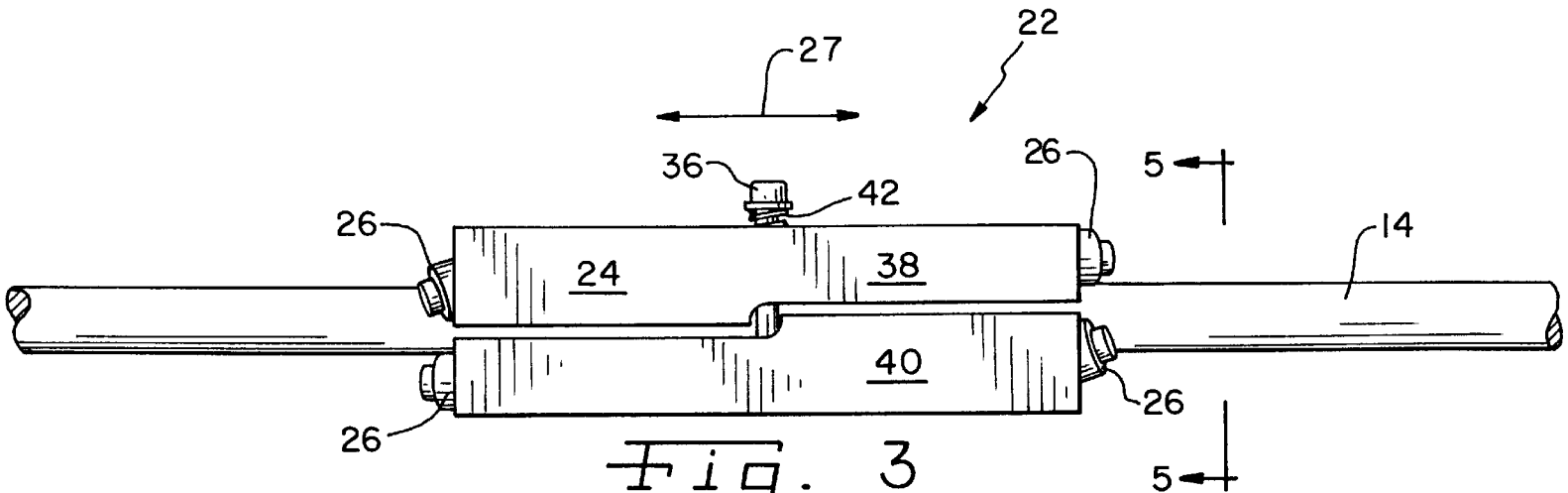
FIG. 3 is a front view of the continuous linear motion transmission device of FIG. 2 as viewed along line 3—3.
Figure 2:
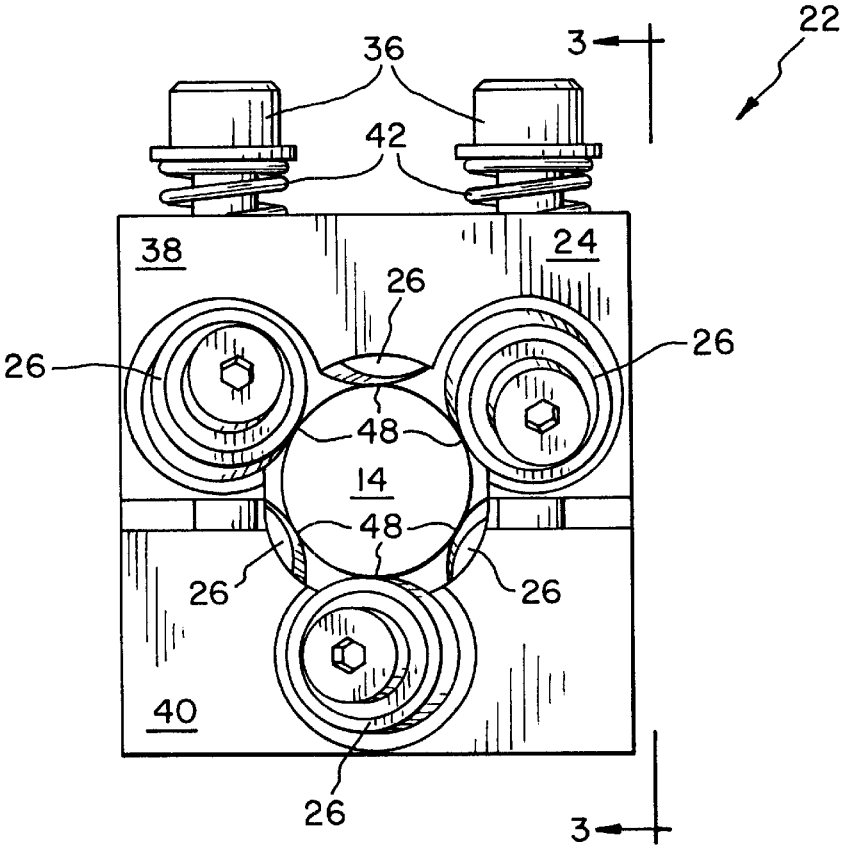
FIG. 2 is a side view of one embodiment of a continuous linear motion transmission device of the present invention.
Figure 4:
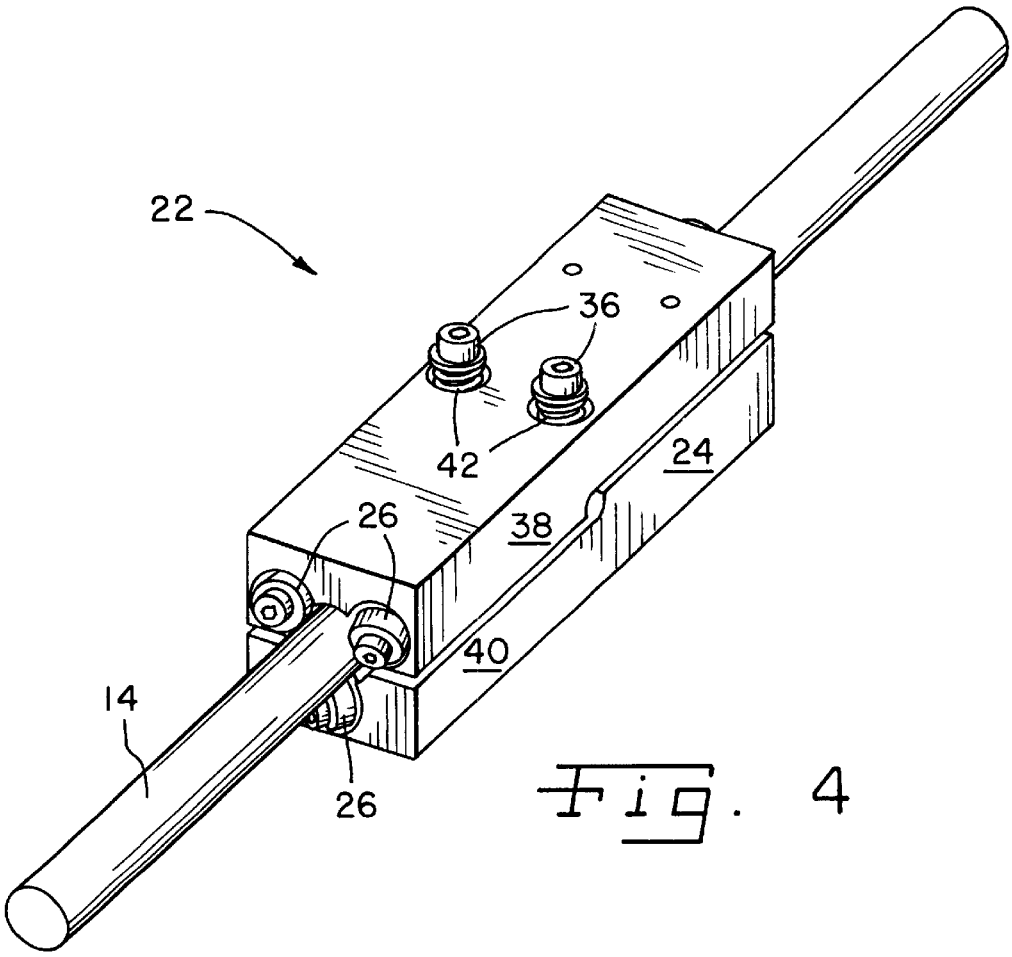
FIG. 4 is a perspective view of the continuous linear motion transmission device of FIG. 2.

A continuous linear motion transmission device (CLMTD) 22 (FIG. 2) of the present invention applies a force to a carrier 24, thereby causing carrier 24 to be accurately traversed and supported regardless of the speed of carrier 24 or the mass of the ink. CLMTD 22 includes six roller bearings 26, each of which is nonparallel to and makes a point contact with carrier support shaft 14. Each of roller bearings 26 is rotatingly attached to carrier 24 such that, while carrier 24 follows the movement of bearings 26, bearings 26 can rotate relative to carrier 24. The three roller bearings 26 of FIG. 2 are positioned approximately 1200 apart on a first end of shaft 14, and, as shown on the right-hand side of FIG. 3, the other three roller bearings 26 are positioned approximately 120° apart on a second, opposite end of shaft 14. FIG. 4 is a perspective view of the CLMTD 22 of FIGS. 2 and 3.

From the viewpoint of FIG. 2, a clockwise rotation of shaft 14 causes carrier 24 to traverse toward the viewer. Conversely, a counterclockwise rotation of shaft 14 causes carrier 24 to traverse away from the viewer. From the viewpoint of FIG. 3, rotation of shaft 14 causes carrier 24 to traverse either left or right along its linear path, which is indicated by double arrow 27.

Figure 5:
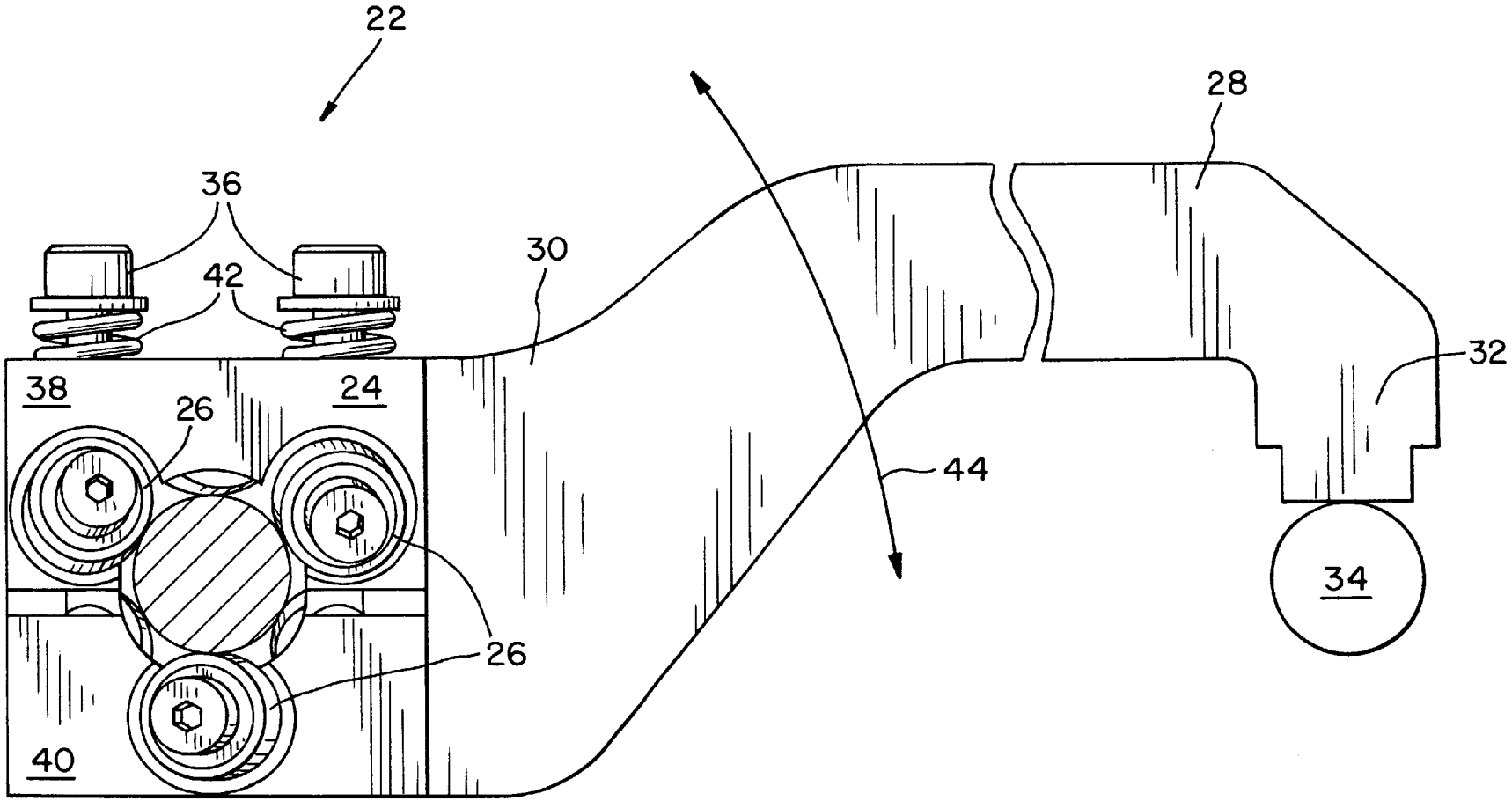
FIG. 5 is a side view of the continuous linear motion transmission device of FIG. 3, as viewed along line 5—5, attached to an arm supported by a second support shaft.

CLMTD 22 acts as a pure rolling support for carrier 24. An arm 28 (FIG. 5) has a first end 30 attached to carrier 24, and a second end 32 resting on and supported by a second support shaft 34. Shaft 34 is parallel to shaft 14. One or more printheads can be attached to either carrier 24 or arm 28. Arm 28 has a significant weight which prevents carrier 24 from rotating counterclockwise in the plane of FIG. 5 when shaft 14 rotates counterclockwise in the plane of FIG. 5. Bolts 36 attach a top half 38 of carrier 24 to a bottom half 40 of carrier 24. Springs 42 are compressed between the heads of bolts 36 and the top surface of carrier 24. Thus, springs 42 bias bearings 26 against shaft 14. Bolts 36 are tightened to a level of tension that prevents bearings 26 from sliding along shaft 14, yet still allows bearings 26 to roll or rotate as shaft 14 rotates in either direction. CLMTD 22 completely constrains the movement of carrier 24 in all but one degree of freedom, which is indicated by the downward portion of double arrow 44. The last rotational degree of freedom is constrained by the simple point support provided by shaft 34. Thus, arm 28 functions as a stop device that prevents carrier 24 from following the rotation of shaft 14. That is, arm 28 prevents carrier 24 from rotating along with the rotation of shaft 14.

Figure 6:
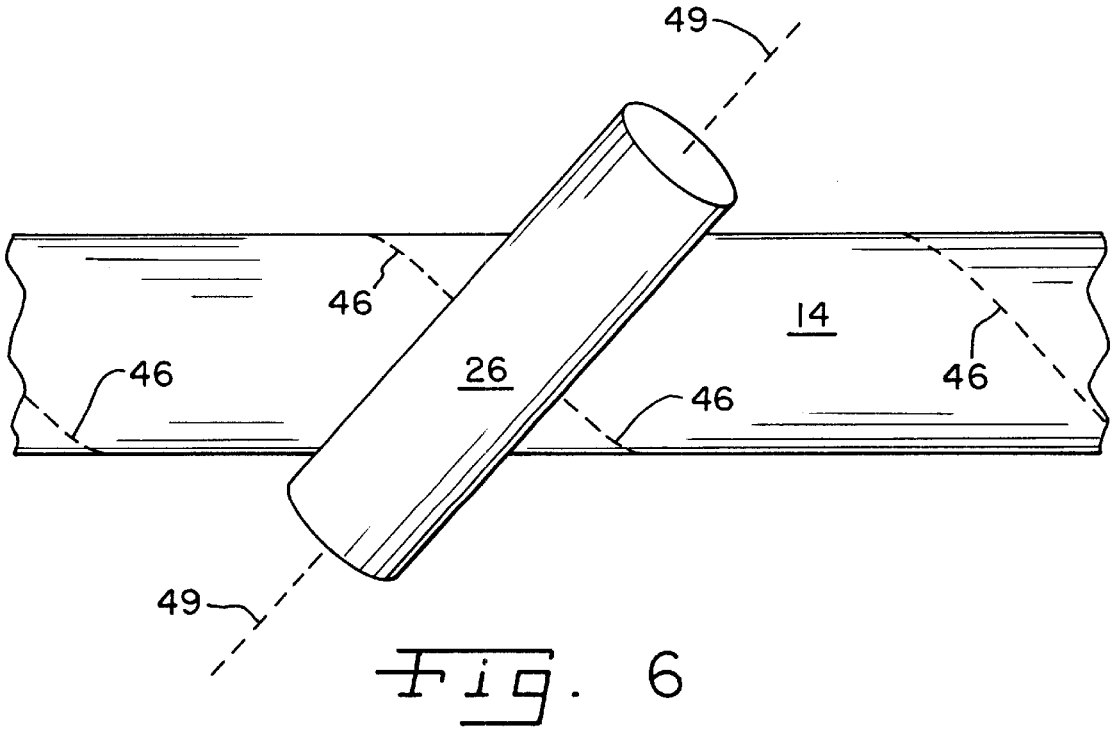
FIG. 6 is a schematic, front view of a roller bearing contacting a support shaft of the continuous linear motion transmission device of FIG. 2.

CLMTD 22 applies a translational force to carrier 24 when first support shaft 14 of CLMTD 22 is rotated. With CLMTD 22 rotationally constrained by the weight of arm 28 and by the simple support provided by shaft 34, the rotating first support shaft 14 causes a traverse force which moves CLMTD 22 and the attached carrier 24 in a linear fashion. This is due to the six roller bearings 26 rolling along respective helical paths on the smooth and grooveless surface of shaft 14. One of the helical paths is indicated by dotted line 46 (FIG. 6). Each bearing 26 makes a point contact 48 with shaft 14 and executes rolling motion, while not allowing sliding motion. Thus, shaft wear is minimal due to the lack of any sliding friction. High loads are also possible due to the pure rolling contact. Bearing 26 rotates about its axis of rotation 49 while executing the rolling motion. The axes of rotation 49 of the bearings are oriented at substantially equal angles relative to shaft 14. This allows each bearing 26 to move carrier 24 a same distance as every other bearing 26 for a given angle of rotation of shaft 14.

Very accurate and smooth shafts are typically placed in inkjet printers today for accurate support of the carrier mechanism. With CLMTD 22, shaft 14 is rotated while support shaft 34 remains stationary. The accuracy of the linear motion of CLMTD 22 is dependant on the tolerances of shaft 14 and the six roller bearings 26 in CLMTD 22. Overall, CLMTD 22 provides a very accurate, efficient, and consistent support and transport for the carrier mechanism.

Figure 7:
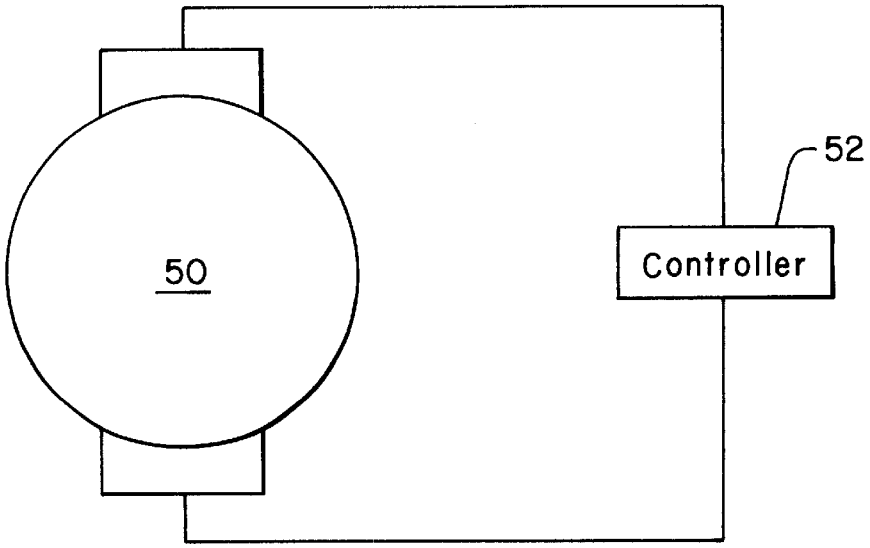
FIG. 7 is a schematic diagram of a motor and controller that can be used to drive the support shaft of the continuous linear motion transmission device of FIG. 2.

The rotation of shaft 14 can be driven by a motor 50 (FIG. 7) that is controlled by a controller 52 based upon a desired position or movement of carrier 24 along shaft 14.

The present invention has been described herein as including roller bearings. However, it is to be understood that it is possible to use other types of bearings, such as ball bearings. Of course it is also possible to use a fewer number or a greater number of bearings than the six bearings illustrated herein.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead carrier assembly in an ink jet printer, said assembly comprising:

a carrier configured to move along a linear path;

at least one rotatable bearing attached to the carrier, said at least one rotatable bearing having at least one axis of rotation; and a rotatable shaft having a surface in contact with said at least one bearing such that said shaft is nonparallel to said at least one axis of rotation of said at least one rotatable bearing and said shaft is substantially parallel to said linear path of said carrier, said shaft being configured such that rotation of said shaft causes said at least one rotatable bearing to roll along a helical path on said surface of said shaft to thereby carry the carrier along said linear path.

2. The assembly of claim 1, wherein said surface of said shaft is at least one of smooth and grooveless.

3. The assembly of claim 1, wherein said rotatable bearing comprises a roller bearing.

4. The assembly of claim 1, wherein said surface of said rotatable shaft is in point contact with said at least one bearing.

5. The assembly of claim 1, wherein said at least one bearing comprises at least three bearings, each said axis of rotation of said at least three bearings being oriented at a substantially equal angle relative to said shaft.

6. The assembly of claim 1, wherein each said bearing is substantially equally spaced around a circumference of said shaft.

7. The assembly of claim 1, wherein said at least one bearing comprises a plurality of bearings spaced along a length of said shaft.

8. The assembly of claim 1, wherein said at least one bearing comprises a plurality of sets of bearings spaced along a length of said shaft, each said set of bearings including more than one said bearing.

9. The assembly of claim 1, further comprising a biasing device configured to bias said at least one bearing against said shaft.

10. The assembly of claim 1, wherein said carrier includes a first part and a second part, said biasing device being configured to bias said first part toward said second part to thereby bias said at least one bearing against said shaft.

11. The assembly of claim 10, wherein said carrier substantially surrounds said shaft.

12. The assembly of claim 1, further comprising a biasing device configured to bias said at least one bearing against said shaft such that said at least one bearing is prevented from sliding along a length of said shaft.

13. The assembly of claim 1, further comprising a stop device configured to prevent said carrier from rotating when said shaft rotates.

14. The assembly of claim 13, wherein said stop device comprises a projection attached to said carrier.

15. The assembly of claim 14, wherein said projection has a weight sufficient to prevent said carrier from rotating when said shaft rotates.

16. The assembly of claim 14, wherein said projection has a proximal end attached to said carrier and a distal end, said assembly further comprising a second shaft substantially parallel to said rotatable shaft, said second shaft supporting said distal end of said projection.

17. A linear motion transmission apparatus for a printhead carrier in an ink jet printer, the carrier moving along a linear path, said apparatus comprising:

at least one rotatable bearing having at least one axis of rotation, said at least one bearing being configured to be attached to the carrier; and a rotatable shaft having a surface in contact with said at least one bearing such that said shaft is nonparallel to said at least one axis of rotation of said at least one rotatable bearing, said shaft being configured to be oriented substantially parallel to the linear path of the carrier, said shaft being configured such that rotation of said shaft causes said at least one rotatable bearing to roll along a helical path on said surface of said shaft to thereby carry the carrier along a length of said shaft.

18. The apparatus of claim 17, wherein said surface of said shaft is at least one of smooth and grooveless.

19. The apparatus of claim 17, wherein said rotatable bearing comprises a roller bearing.

20. The apparatus of claim 17, wherein said surface of said rotatable shaft is in point contact with said at least one bearing.

21. The apparatus of claim 17, wherein said at least one bearing comprises at least three bearings, each said axis of rotation of said at least three bearings being oriented at a substantially equal angle relative to said shaft.

22. The apparatus of claim 17, wherein each said bearing is substantially equally spaced around a circumference of said shaft.

23. The apparatus of claim 17, wherein said at least one bearing comprises a plurality of bearings spaced along said length of said shaft.

24. The apparatus of claim 17, wherein said at least one bearing comprises a plurality of sets of bearings spaced along said length of said shaft, each said set of bearings including more than one said bearing.

* * * * *